US009539158B2

(12) United States Patent
Cassidy et al.

(10) Patent No.: US 9,539,158 B2
(45) Date of Patent: Jan. 10, 2017

(54) LIQUID SEQUESTRATION BAG WITH PINCH CLOSURE

(71) Applicant: American Innotek, Inc., Escondido, CA (US)

(72) Inventors: Clarence A. Cassidy, Escondido, CA (US); Niki J Kopenhaver, Romana, CA (US); Edward P Royka, Jr., Oceanside, CA (US); Steven M. Patlan, Winchester, CA (US)

(73) Assignee: American Innotek, Inc., Escondido, CA (US)

( * ) Notice: Subject to any disclaimer, the term of this patent is extended or adjusted under 35 U.S.C. 154(b) by 0 days.

(21) Appl. No.: 13/921,932

(22) Filed: Jun. 19, 2013

(65) Prior Publication Data

US 2014/0376832 A1 Dec. 25, 2014

(51) Int. Cl.
*A61G 9/00* (2006.01)
*A61J 19/02* (2006.01)

(52) U.S. Cl.
CPC ..... *A61G 9/006* (2013.01); *A61J 19/02* (2013.01)

(58) Field of Classification Search
CPC ..... A61F 5/44; A61F 5/4405; B65D 31/14; B65D 31/145; Y10S 128/24; A61J 19/02; A61G 9/006
USPC ..... 383/48, 93, 94, 127
See application file for complete search history.

(56) References Cited

U.S. PATENT DOCUMENTS

| | | | | |
|---|---|---|---|---|
| 2,800,269 | A | | 7/1957 | Smith |
| 2,804,257 | A | | 8/1957 | Hasler et al. |
| 3,189,252 | A | | 6/1965 | Miller |
| 3,297,152 | A | | 1/1967 | Arthur et al. |
| 3,367,485 | A | * | 2/1968 | Schneider et al. ..... 206/221 |
| 3,368,561 | A | | 2/1968 | Ericson et al. |
| 3,403,410 | A | | 10/1968 | Benzel et al. |
| 3,403,715 | A | | 10/1968 | Charles |
| 3,920,179 | A | * | 11/1975 | Hall ..... 604/317 |
| 4,246,909 | A | | 1/1981 | Wu et al. |
| 4,533,354 | A | | 8/1985 | Jensen |
| 4,686,814 | A | | 8/1987 | Yanase |
| 4,723,944 | A | | 2/1988 | Jensen |
| 4,822,180 | A | | 4/1989 | Gjelstrup et al. |
| 4,865,464 | A | | 9/1989 | Enzu |

(Continued)

FOREIGN PATENT DOCUMENTS

| | | |
|---|---|---|
| CN | 2706166 U | 6/2005 |
| DE | 20212359 | 11/2002 |

(Continued)

*Primary Examiner* — Peter Helvey
(74) *Attorney, Agent, or Firm* — Gordon & Rees LLP

(57) ABSTRACT

The bag has a closure mechanism that simplifies and reduces the cost of the bag as compared to bags with conventional one-way valves. In one embodiment the valve is formed by two bond lines extending across the width of a plastic bag at different heights and terminating with one bond line above the other to leave an opening through which the bag is filled. Hydrophilic material expands to tension the opening and pinch it closed. In a second embodiment the one-way valve is formed on the angled edges of a two layer insert. This embodiment is functional with or without hydrophilic material. In both embodiments a supplemental closure is secured at the top of the bag to simplify opening the bag top and holding the bag while in use.

8 Claims, 10 Drawing Sheets

(56) References Cited

U.S. PATENT DOCUMENTS

| | | | | |
|---|---|---|---|---|
| 6,345,911 | B1 | 2/2002 | Young et al. | |
| 8,419,278 | B2 * | 4/2013 | Tanaka | 383/44 |
| 2004/0064112 | A1 | 4/2004 | Sun | |
| 2005/0108393 | A1 | 5/2005 | Banerjee et al. | |
| 2006/0056861 | A1 | 3/2006 | Nojima | |
| 2007/0179458 | A1 | 8/2007 | Leroy et al. | |
| 2010/0150480 | A1 | 6/2010 | Lacointe | |
| 2012/0046623 | A1 | 2/2012 | Bordeau | |

FOREIGN PATENT DOCUMENTS

| | | |
|---|---|---|
| GB | 909977 | 11/1962 |
| GB | 855804 | 12/1969 |
| GB | 1319442 | 6/1973 |
| GB | 1466854 | 3/1977 |
| GB | 1569647 | 6/1980 |
| JP | 5118455 | 1/2013 |
| WO | WO9008525 | 8/1990 |
| WO | WO2010141094 | 12/2010 |
| WO | WO2011084018 | 7/2011 |

* cited by examiner

LIQUID SEQUESTRATION BAG WITH PINCH CLOSURE

FIELD OF THE INVENTION

The present invention relates generally to bags for accepting and sequestering liquid and more particularly to a two layer bag with an opening closed by the expansion of hydrophilic material, and to a two-layer bag with insert with an opening that collapses upon the expansion of hydrophilic material.

BACKGROUND OF THE INVENTION

Simplified closure mechanisms have been proposed using bonds (plastic welds) to create restricted passages which tend to close upon the gelation of polymer and the inversion of the bag. Publication U.S. 20040064112 is such as bag. However in the applications' configuration, with two openings and four bond lines, the flow of liquid into the bag is so restricted that its use, for example, as a urine collection bag is impractical because the portion of the bag above the bonds has inadequate capacity for liquid quantities on the order of twenty ounces, and during the extended time it would take for whatever quantity of liquid that can be accommodated in the upper portion of the bag will spill out if the bag is shaken or inverted.

Liquid collection bags have been developed for various purposes to admit liquid into a reservoir and then use an absorbent such as polymer to gel the liquid and prevent it from leaking out of the bag.

For example, liquid collection bags have been used to collect urine and which feature a funnel insert in a flexible plastic bag and with a one-way valve. As in the U.S. Pat. No. 5,116,139 the funnel itself can also serve as a one-way valve as the polymer expands. This configuration is generally satisfactory in function but requires an extra manufacturing step of first attaching an inverted funnel outside of the bag to the top of the bag and second pressing the funnel inside out so that it is contained within the bag.

SUMMARY OF THE INVENTION

The present invention overcomes the deficiencies in the prior art in a bag that can comprise only two bond lines (two-layer bag) or on a two layer insert secured in that bag (two-layer bag with insert). In either configuration one line is longer than the other with the longer line nearest the top of the bag and at a downward sloping angle of 50 to 70 degrees, and a shorter bond line from the opposite side of the bag, that terminates, spaced from the terminus of the long bond line, to form an opening for the entry of liquid. The lower bond line can be in the range of 90 degrees (horizontal with the bag upright) to 50 to 70 degrees from the vertical and sloping downwardly.

The flow of liquids into the bag is guided by the longer bond line to the opening. The space below the bond lines contains a sufficient quantity of hydrophilic material that absorbs the liquid and forms a gel. In a two-layer bag, the hydrophilic material is present in sufficient quantity that when fully gelled, it presses on the bond lines and the sides of the bag. This pressure tensions the layers of plastic at the opening which has the effect of closing the opening. For purposes of this application closing an opening by tensioning the layers at the opening is referred to as a pinch. The combination of the gelled hydrophilic material and the tension the bag caused by the polymer pressing the sides of the bag causes the material in the opening to pinch the opening substantially closed to prevent any significant reflux of the gelled liquid.

A bag with a width of 5.75 inches and 0.5 inches in height above the outer point or edge of the upper bond line, can accept 20 ounces of liquid in 4.88 seconds using the largest recommended opening (1.64 w×1.23 h) and 12.6 seconds using the smallest recommended opening (0" w×1.5 h). The flow rate of liquid through the opening is sufficiently unrestricted that virtually none of the liquid resides in the upper portion of the bag during filling. This essentially eliminates spillage should the bag be dropped or tipped over when it is being used.

In an exemplary embodiment of the invention a bag that is 5.75 inches wide has an upper bond line that extends from an edge of the bag downward as 60 degrees from the horizontal approximately ⅔ of the way across the bag, and a lower bond line that extends from the opposite edge of the bag approximately ⅓ of the width of the bag. The lower bond line terminates at a distance from the terminus of the upper bond line to create an opening that is between 0.5 to 1.5 inches in size and preferably approximately 0.8 inches.

Depending on the angle to the vertical of the opening, the lower bond line terminates at a distance from the terminus of the upper bond line to create a rectangular or linear opening that is between 0 & 1.64 inches wide (horizontal) and between 0.06 & 1.55 inches high (vertical).

The reservoir formed below the opening in an exemplary embodiment may have 13.5 grams of polymer absorbent as the hydrophilic material and which swells sufficiently to pinch the opening so that the gel cannot escape from the reservoir.

In an alternative configuration the bond lines are formed on an insert that is received within a two-layer bag where the bag has no bond lines. The area above the bond lines therefore has four layers (two for the bag and two for the insert). The insert can be thought of as being cut off and bonded at angles comparable to the bond lines in the two layer bag. It is preferable to have the long bond above the short bond. The inner terminus of the long bond is above and spaced from the inner terminus of the short bond. This configuration has an inflow characteristic that is substantially the same as the two layer configuration but has greater security in the closure of the opening because the insert has no constraint in its ability to collapse when the bag is inverted. This is, in part, because the insert is not attached to the bag except at the top. The insert can be bonded to the bag with a horizontal bond immediately below the top of the bag or of its closure.

When the bag is tipped or inverted the liquid exerts pressure on the bond lines and the lower bond line is bent back on itself creating a positive closure of the opening. Depending upon the application the two layers with insert configuration can be used without hydrophilic material. Since the liquid which passes through the opening is not exposed to hydrophilic expansive material, the liquid is preserved in its original state and therefore could be, for example, blood products, or any other liquid which does not react with the plastic film employed.

In either embodiment the flexible plastic may suitably be a plastic film of linear low density polyethylene. A thickness of the film of 3 to 4 mil has been found to be satisfactory.

The material referred to herein as polymer powder, when used with urine is preferably a combination of a super absorbent polymer and an enzyme that breaks down the organic content of the urine so that it can be safely disposed of in an ordinary trash container. These polymer materials are normally in powder form and can be contained unpackaged in the lower reservoir, or can be contained in a pouch of water soluble material such as a paper which prevents any escape of the powder, for example, when the unfilled bag is inverted.

The bag of the invention lends itself to a use with a second security closure such as a zip-lock™ style closure at the top of the bag and above the uppermost portion of the bond lines, or by a closure such as a plastic top with rolled edges and with a lock open feature to facility use by both male and female users. The plastic top can be secured by interfitting linear closures that extend across virtually the entire top, or can incorporate a single snap closure. The invention will be more completely understood by reference to the drawings and the detailed description

BRIEF DESCRIPTION OF THE DRAWINGS

These and other features of the invention are described in further detail in the following description and will be better understood with reference to the accompanying drawings, which are briefly described below.

DETAILED DESCRIPTION

Figure 1:
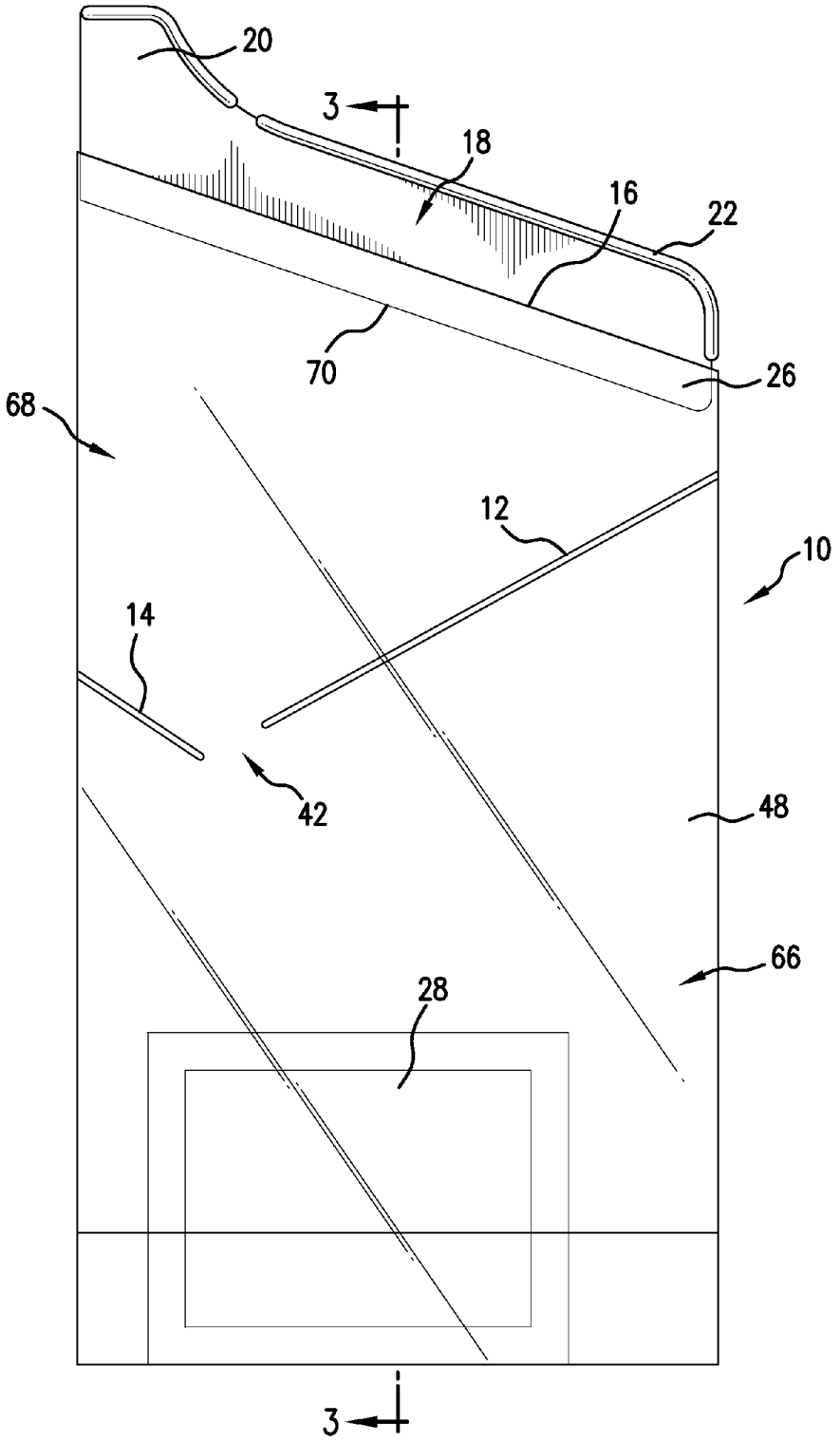
FIG. 1 is a front elevation view of a two-layer bag with a polymer packet in the reservoir.

Exemplary embodiments of the invention are described in detail below with reference to the appended figures, wherein like elements are referenced with like numerals throughout. The figures are not necessarily drawn to scale and do not necessarily show every detail or structure of the various embodiments of the invention, but rather illustrate exemplary embodiments and mechanical features in order to provide an enabling description of such embodiments.

The features of the invention are identified as follows: Two-layer bag 10, upper bond line 12, lower bond line 14, angulated bag top 16, upper supplementary closure 18, hold open and grip section 20, rounded edges 22 and 24, overlap of bag on closure 26, polymer pouch 28, pleat 30, inverted bag 32, pinched opening 42, insert 36, upper insert edge bond 38, lower insert edge bond 40, opening 42, collapsed opening 46, first bag side 48, second bag side 50, first supplemental closure side 52, second closure side 54, upper supplementary closure locking tabs 56, expanded hydrophilic material 58, insert opening 60, folded pleat line 62, collapsed lower insert edge 64, lower reservoir 66, upper funneled entry 68, lower edge of supplement closure 70, first insert layer 72 and second insert layer 74, liquid 76.

As used herein the bag is described as having two layers, this term should be understood to include two flat pieces of bag material or a tube of plastic where the layers are formed by securing the tubular stock to the upper supplemental closure which is of material that is stiffer than the sheet material of the bag and by bonding the layers together at the bottom.

Referring to FIG. 1, the bag 10 is shown to comprise a first bag side 48 with upper bond line 12 securing the two layers of the bag together. A suitable material for the bag is plastic film approximately 0.003 inches in thickness. A suitable material for the bag is a heat sealable film such as polyethylene.

The bond line 12 may desirably be formed by heat welding of the plastic bag material, or by adhesive bonding. The bond line 12 is angled downwardly to guide liquid introduced into the bag toward the opening 42. The lower bond line 14 may also angle downwardly or be essentially horizontal. The lower bond line 14 terminates spaced from the upper bond line 12 by a distance that creates the opening 42. The bond lines separate the bag into an upper entry chamber 68 and a lower reservoir 66. The capacity of the lower reservoir 66 is determine by the intended use of the bag 10. When used as a bag for disposal of urine, the lower reservoir 66 preferably has a capacity of approximately 24 fluid ounces.

The upper secondary closure 18 is formed of a material that is stiffer than the bag material and may suitably be made of a molded plastic material. The use of a supplemental closure has been employed in other prior devices, but in the present embodiment has been modified to reduce the amount of material required to form the closure. This is accomplished by angulation of the lower edge 70 of the supplemental closure 18. For purposes of clarity the bag material is shown as being transparent, but in practice the bag 10 may be translucent or opaque.

Figure 2:
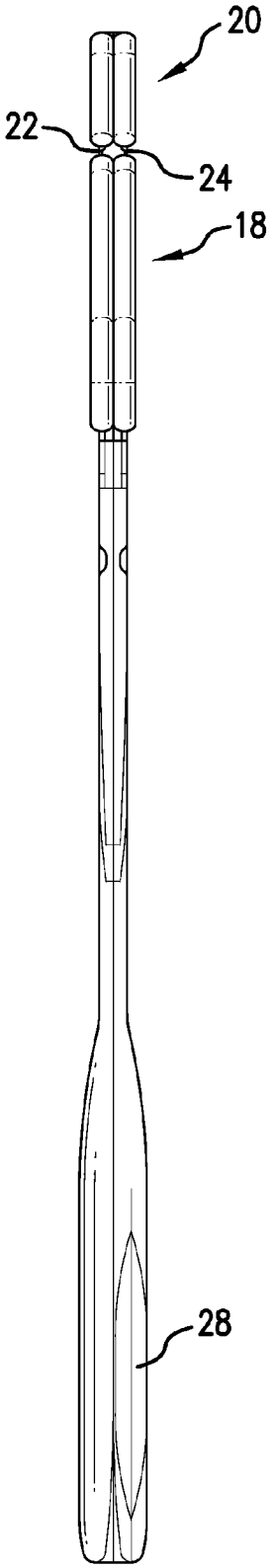
FIG. 2 is a side view of two-layer bag.

FIG. 2 shows a side view of the bag where the upper secondary closure 18 is shown to include two sides 22 and 24. The grip section 20 is used to hold the bag open by bending the hold open which accomplishes the hold open function and also creates a tab with which the bag can be held while it is in use. The upper edges 22 and 24 and 18 of the supplemental closure are rounded for stiffening and to avoid sharp edges that might be injurious to the user.

Figure 3:
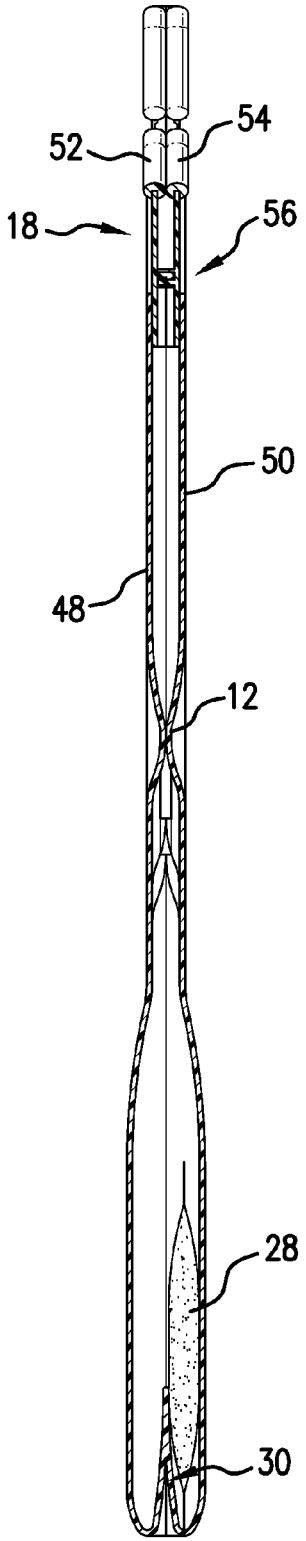
FIG. 3 is a side cross-sectional view of a two-layer bag showing the pleat at the bottom. which allows the bag to stand upright after the polymer is expanded.

FIG. 3 is a cross-sectional view of the bag, taken of line 3-3 of FIG. 1. The upper bond line 12 shows the two layers 48 and 50 to be secured together. The closure is shown at 56 and may desirably snap together to create a closure extending across all or part of the supplemental closure 18. The closure 56 is to provide supplemental security in containing the gelled liquid after use and allows the bag to manipulated, such as by tossing it into a rubbish container, without the risk of any gelled material escaping and also to provide a means for holding the bag open and allowing comfortable use in contact with the body as in the case of a female user.

Figure 4:
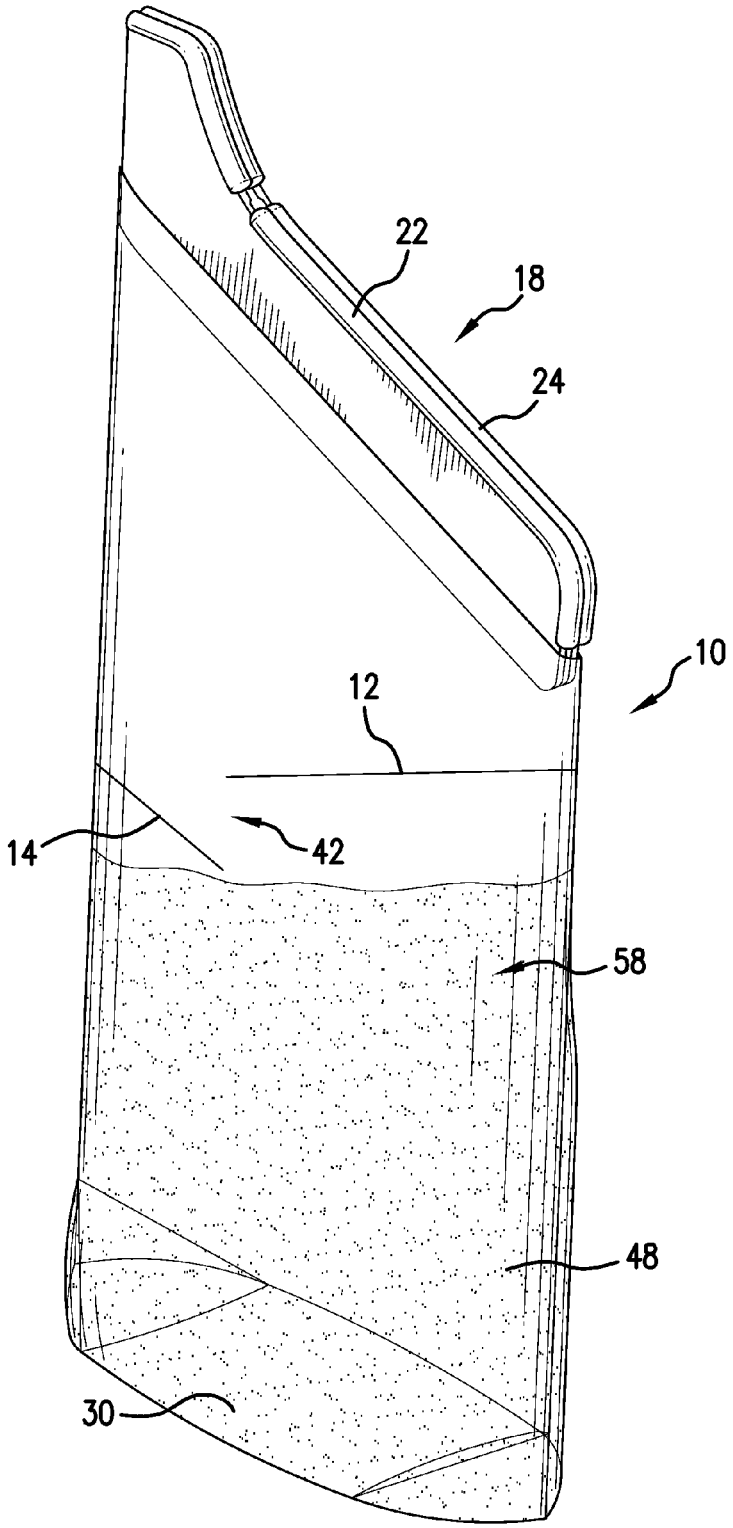
FIG. 4 is a perspective view of the bag after liquid has entered the bag and the polymer has expanded into contact with the bond lines and the sides of the bag adjacent the bond lines.

Referring again to FIG. 1, liquid passing through the opening 42 is exposed to the packet 28. Packet 28 is comprised of soluble paper or other soluble or liquid penetrable material and contains a quantity of expansive hydrophilic material which in the exemplary embodiment is a polymer powder. FIG. 4 shows the bag 10 after the hydrophilic material 58 has absorbed all of the liquid and swollen to fill the lower reservoir 48. The swollen material 58 presses against the sides of the bag 10 and also against the bond lines 12 and 14. As a result there is tension on the opening 42, causing it to pinch closed and prevents the gelled material 58 from exiting the bag 10. The swelling also extends the pleat 30 so that it forms a flat lower section which also the bag to stand upright such as on a table. This allows the user time to locate a trash or other disposal container.

Figure 4A:
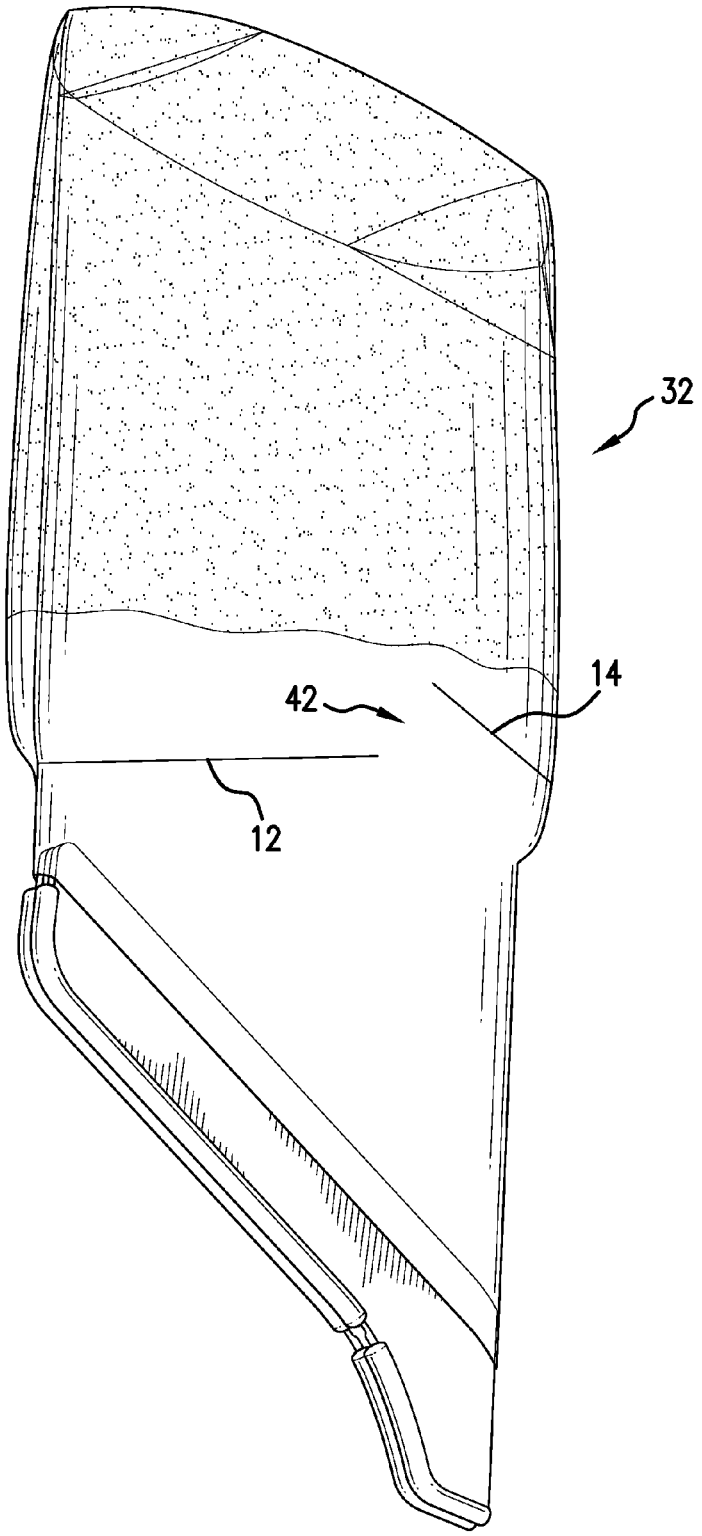
FIG. 4A is a perspective view of the bag of FIG. 4, showing the bag inverted with the pinch at the opening preventing liquid or gelled material from exiting the bag.

FIG. 4A shows how the original flat sides are distorted by the hydrophilic material which causes the tension on the bag between the upper and lower bond lines and therefore the opening 42 is pinched at 42. The bag 32 is shown inverted to illustrate that after the swelling is complete, the bag can be inverted without any reflux of the hydrophilic material.

Figure 5:
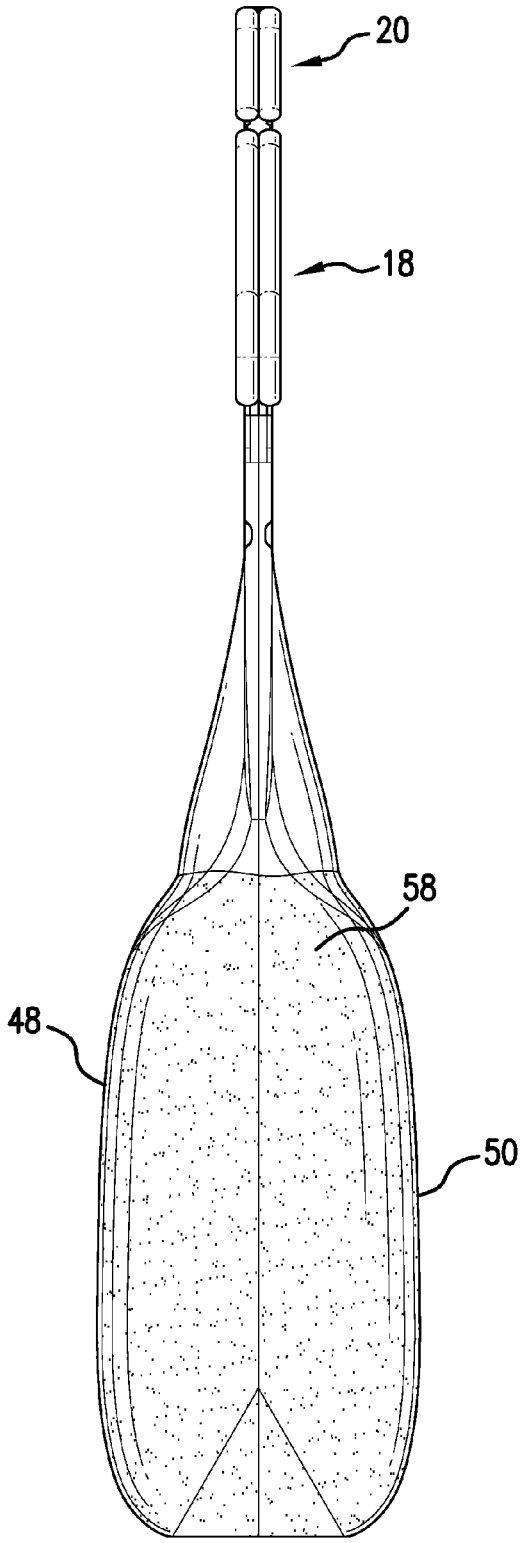
FIG. 5 is a side view of the bag with expanded polymer.

FIG. 5 is a side view of the bag in FIG. 4, showing the distortion of the bag sides 48 and 50 which result from the expansion of the hydrophilic material 58.

Figure 6:
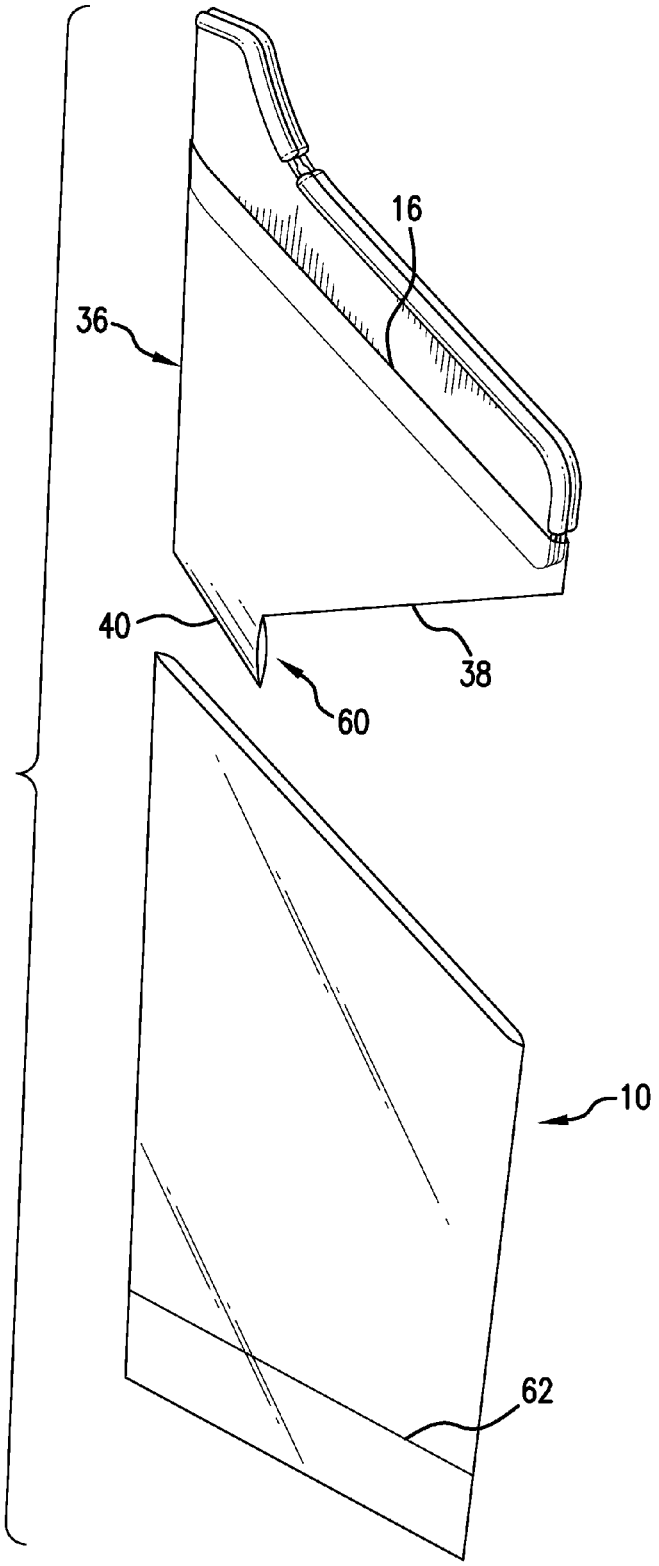
FIG. 6 is a perspective view of an insert and top positioned to be inserted into a two layer bag.

FIG. 6 shows the insert embodiment of the invention. The insert 36 is shown before it is inserted and secured in the bag 10 so that the detailed construction of the insert is visible. The insert has edge bonds that correspond in their location to the bond lines 12 and 14 of the two-layer configuration. The upper edge 38 is bonded at the edge, and the lower edge is bonded at the edge 40. Since the lower edge 38 terminates below the upper edge 40 there is an unbonded section between the terminus of the edges which forms the opening 60. The folded pleat is shown by the fold line 62.

Figure 7:
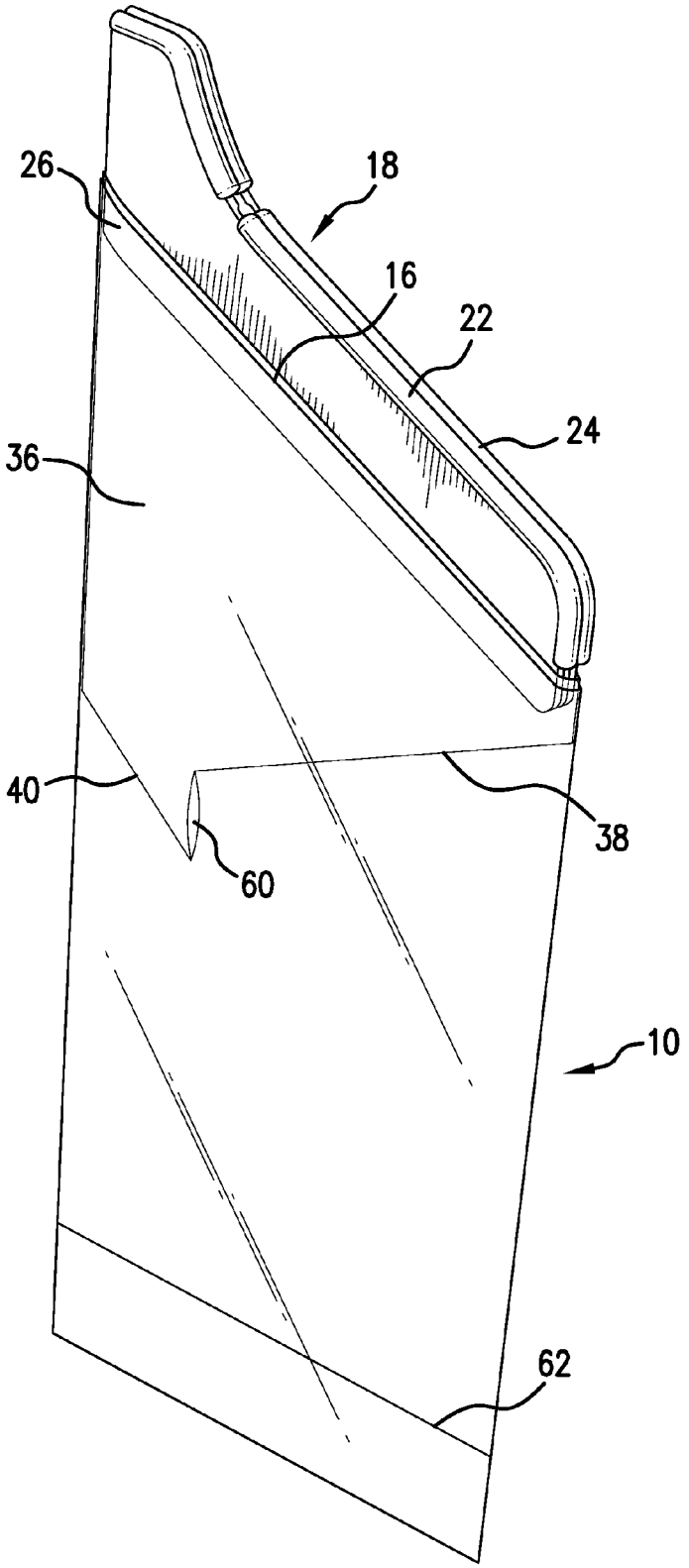
FIG. 7 is a perspective view of the bag of FIG. 6, with the insert fully inside the two-layer bag.

FIG. 7 shows the insert embodiment fully assembled with the insert 36 in place in the bag 10. The upper edge of the bag 16 is angulated to mate with the upper secondary closure with the overlap 26 in position where is can be secured to the upper supplemental closure 18 by adhesive or other bonding.

Figure 8:
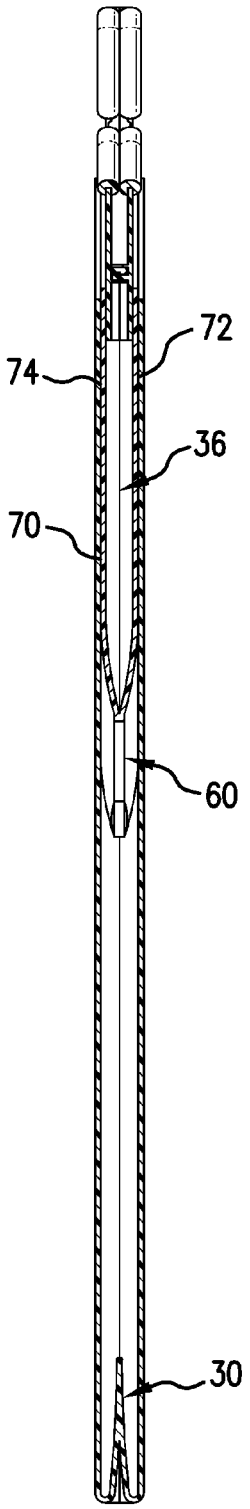
FIG. 8 is a side cross-sectional view of the two-layer bag with insert.

FIG. 8 is a cross-sectional view of the bag of FIG. 7 showing the pleat 30 and the opening 60. FIG. 8 shows the insert 36 which comprises two additional to layers 70 and 72.

Figure 9:
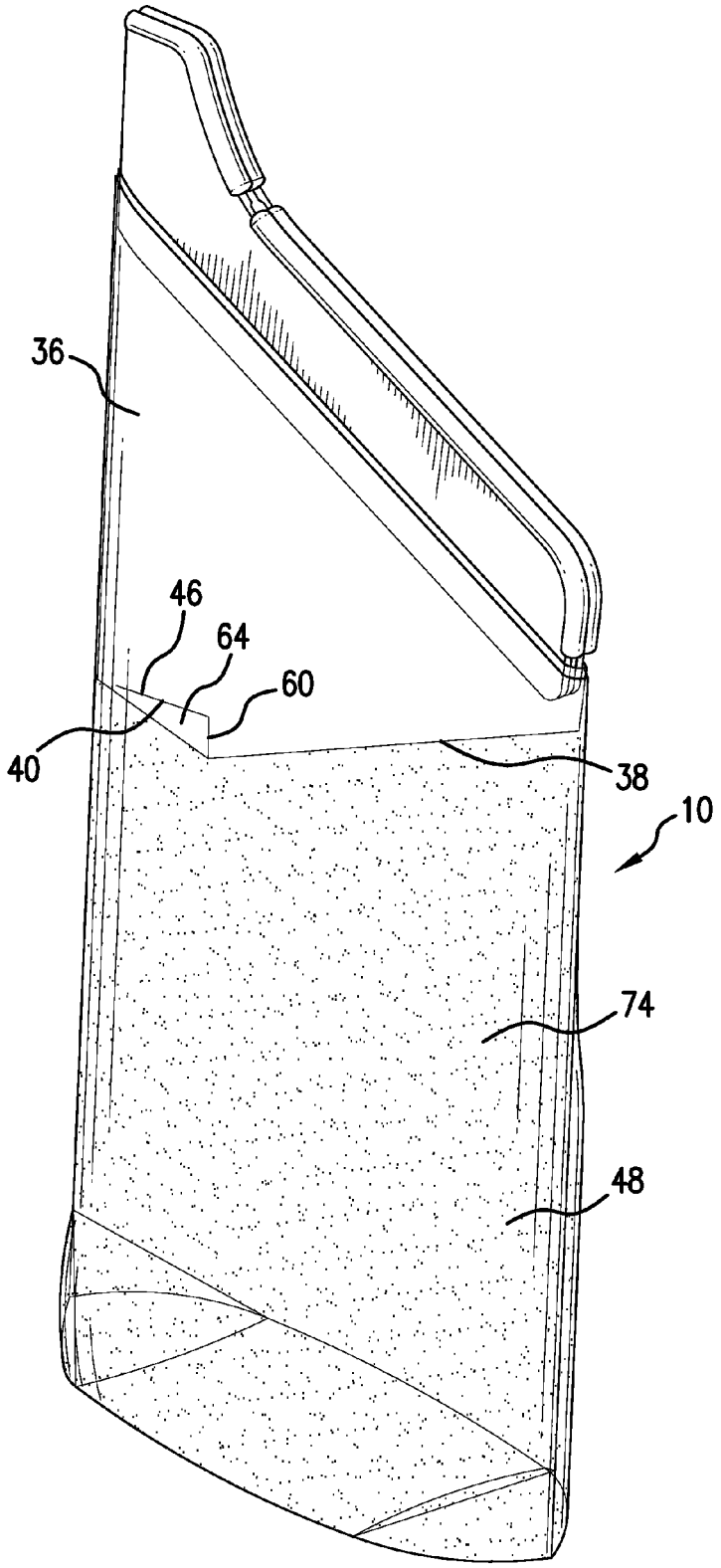
FIG. 9 is a perspective view of the two layer bag with insert showing the hydrated expansive material in contact with the insert and closing the opening in addition to showing the expanded pleat which allows the bag to stand on a horizontal surface.

FIG. 9 shows the lower reservoir 48 which is filled with liquid 74 (shown by shading). When full as shown or when the bag 10 is inverted, the pressure of the liquid 74 collapses the lower edge 40 of insert 36, effectively closing the opening 60. Although the bag 10 in FIG. 9 is shown with only water in the lower reservoir 48, it can also be utilized with expansive hydrophilic material which provides an even more secure closing of the valve because the expansive hydrophilic material once expanded closes the opening 60 and keeps it closed regardless of the handling of the bag.

Various modifications and alterations of the invention will become apparent to those skilled in the art without departing from the spirit and scope of the invention, which is defined by the accompanying claims. For example, it should be noted that steps recited in any method claims below do not necessarily need to be performed in the order they are recited. For example, in certain embodiments, steps may be performed simultaneously. The accompanying claims should be constructed with these principles in mind.

Any element in a claim that does not explicitly state "means for" performing a specified function or "step for" performing a specified function is not to be interpreted as a "means" or "step" clause as specified in 35 U.S.C. §112, ¶6.

What is claimed is:

1. A bag for collecting and sequestering a liquid comprising:

a flexible plastic material forming a bag with an open top and having two layers of the plastic material overlying one another;

a closeable opening formed by two bond lines joining the layers of plastic material:

wherein the bond lines include an upper bond line and a lower bond line that divide the bad into an upper entry chamber and a lower reservoir fluidly connected by the closeable opening;

wherein the upper bond line extends downwardly at an angle of less than 45 degrees from the horizontal from a first side of the bag, wherein the upper bond line extends from the first side of the bag a distance of more than one-half of the width of the bag at the widest part of the bag and has a terminus before reaching a second side of the bag;

wherein the lower bond line extends from the second side of the bag and terminates below the terminus of the upper bond line;

a hydrophilic absorbent material located in the lower reservoir, wherein the absorbent material expands after absorbing the liquid to flex the bag at the upper bond line and the lower bond line and tensions the layers of plastic material at the closeable opening to form a pinch closing the opening.

2. The bag of claim 1, further comprising a supplemental closure; wherein the supplemental closure is made from a stiffer plastic material than the bag.

3. The bag of claim 1, wherein the upper bond line extends a longer distance than the lower bond line.

4. The bag of claim 1 wherein: the opening between the terminus of the two bond lines forms an opening having a width of between 0.5 inches and 1.5 inches.

5. The bag of claim 1, wherein: the upper bond line extends downwardly at an angle of between 50 and 70 degrees from the vertical.

6. The bag of claim 5, wherein: the upper bond line extends downwardly at an angle of substantially 60 degrees.

7. The bag of claim 1, wherein: the bag has and upper edge that is angulated so that one side of the bag is longer than the other and where the supplemental closure has a lower edge with substantially the same angulation as the upper edge of the bag.

8. A bag for collecting and sequestering a liquid comprising:

a flexible plastic material including two layers of plastic material overlying one another and connected together to form the bag having a top, a bottom and first and second sides;

wherein the bag is divided into an upper entry chamber and a lower reservoir by two bond lines connecting the layers of plastic material;

wherein each of the two bond lines extend from one of the sides of the bag and terminate in the interior of the bag wherein a closeable opening fluidly connects the upper entry chamber and the lower reservoir and is located between termini of the two bond lines;

wherein the bond lines include an upper bond line and a lower bond line;

wherein the upper bond line extends downwardly at an angle greater than 135 degrees from a first side of the bag and extends across the bag further than one-half the of the width of the bag at the widest part of the bag;

wherein the lower bond line extends from a second side of the bag and terminates below the terminus of the upper bond line;

a hydrophilic absorbent material is located in the lower reservoir, and wherein the bond lines and the opening are configured so that when the absorbent material expands upon absorbing the liquid to expand the lower chamber and cause the bag to be pinched, the opening closes to prevent material from escaping the lower reservoir through the closeable opening.

* * * * *